US007315717B2

(12) United States Patent
Mizuta

(10) Patent No.: US 7,315,717 B2
(45) Date of Patent: Jan. 1, 2008

(54) DEVELOPER APPARATUS, IMAGE FORMING APPARATUS AND DEVELOPER COLLECTING METHOD

(75) Inventor: Katsunori Mizuta, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 309 days.

(21) Appl. No.: 11/206,109

(22) Filed: Aug. 18, 2005

(65) Prior Publication Data

US 2007/0041750 A1 Feb. 22, 2007

(51) Int. Cl.
*G03G 15/08* (2006.01)

(52) U.S. Cl. ..... 399/283; 399/119; 399/120

(58) Field of Classification Search ..... 399/111, 399/119, 120, 252, 265, 279, 283
See application file for complete search history.

(56) References Cited

U.S. PATENT DOCUMENTS 5,086,728 A * 2/1992 Kinoshita ..... 399/281
6,026,265 A * 2/2000 Kinoshita et al. ..... 399/281
6,408,142 B1 * 6/2002 Takeuchi et al. ..... 399/13
6,577,829 B2 * 6/2003 Higeta et al. ..... 399/109
2006/0257175 A1 * 11/2006 Endo et al. ..... 399/281

FOREIGN PATENT DOCUMENTS

JP 05-303312 A 11/1993

* cited by examiner

*Primary Examiner*—Hoan Tran
(74) *Attorney, Agent, or Firm*—Foley & Lardner LLP

(57) ABSTRACT

An image forming apparatus according to the present invention has a resin sheet 20 contacting a collecting roller 18 between a developing unit casing 11 and a collecting roller 18, wherein a scraper 18*a* which is provided on the collecting roller and projected over the total length scrapes toner adhered to the resin sheet 20, and the toner is ejected to a duct mechanism 115 provided under the resin sheet.

20 Claims, 6 Drawing Sheets

DEVELOPER APPARATUS, IMAGE FORMING APPARATUS AND DEVELOPER COLLECTING METHOD

BACKGROUND OF THE INVENTION

1. Field of the Invention

The present invention relates to an image forming apparatus for forming an image using developer, a developing unit included in this image forming apparatus, and a method of collecting developer of the developing unit.

2. Description of the Related Art

An image forming apparatus for forming an image using developer including toner for example forms an electrostatic latent image on a photoconductive drum as an image carrier, develops the static image in a developing unit, transfer a toner image obtained onto a paper sheet in a transfer unit, and fix the image on the paper sheet in a fixing unit.

There is a known image forming apparatus, which has a toner-collecting device for collecting the toner scattered when being supplied from a developing unit to a photoconductive drum.

For example, Jpn. Pat. Appln. KOKAI Publication No. 5-303312 discloses a toner-collecting unit, which is provided in a cleaning unit, and has an elastic collecting blade 6 composed of elastic thin plate such as Mylar and touched to a collecting roller having a polygonal cross section (paragraph 0016).

If a relatively hard material such as Mylar is used for an elastic collecting blade, the force of the elastic collecting blade to return to the original state is too strong, and causes adhesion of scattered toner to a photoconductive drum. The adhesion of scattered toner to a photoconductive drum causes a defective image.

BRIEF SUMMARY OF THE INVENTION

According to an aspect of the present invention, there is provided a developing unit comprising:

a developer container to contain developer;

a developing member to supply the developer to an image carrier;

a collecting member which is placed in the vicinity of a developer supply position to supply the developer from the developing member to the image carrier, and collects the developer scattered when supplied from the developing member to the image carrier;

an elastic member which is provided in a gap between the developer container and the collecting member, and pressed to the collecting member with one end fixed to the developer container by being pressed and bent along the rotating direction of the collecting member; and a projection which has a form projected from the surface of the collecting member, and scrapes the developer adhered to the elastic member by pressing and bending the elastic member by the rotation of the collecting member.

According to another aspect of the present invention, there is provided an image forming apparatus comprising:

an image carrier to carry electrostatically a developer image formed with a developer;

a developer container to contain developer;

a developing member to supply the developer to the image carrier;

a collecting member which is placed in the vicinity of a developer supply position to supply the developer from the developing member to the image carrier, and collects the developer scattered when supplied from the developing member to the image carrier;

an elastic member which is provided in a gap between the developer container and the collecting member, and pressed to the collecting member with one end fixed to the developer container by being pressed and bent along the rotating direction of the collecting member; and a projection which has a form projected from the surface of the collecting member, and scrapes the developer adhered to the elastic member by pressing and bending the elastic member by the rotation of the collecting member.

According to further aspect of the present invention, there is provided an image forming apparatus comprising:

an image carrying means for carrying electrostatically a developer image formed with a developer;

a developer containing means for containing developer;

a developer supplying means for supplying the developer to the image carrying means;

a collecting means which is a member provided rotatably, placed in the vicinity of a developer supply position to supply the developer from the developer supplying means to the image carrying means, and collects the developer scattered when supplied from the developer supplying means to the image carrying means;

an elastic member which is provided in a gap between the developer containing means and the collecting member, and pressed to the collecting means with one end fixed to the developer containing means by being pressed and bent along the rotating direction of the collecting means; and a projection which has a form projected from the surface of the collecting means, and scrapes the developer adhered to the elastic member by pressing and bending the elastic member by the rotation of the collecting member.

According to further another aspect of the present invention, there is provided a developer collecting method comprising:

supplying developer to the surface of an image carrier;

collecting the developer scattered when being supplied, with a collecting member having a projection projected from the surface;

scraping the developer collected by the collecting member, by an elastic member pressed to the collecting member; and ejecting the developer scrapped by the elastic member, by the projection of the collecting member pressed to the elastic member.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An example of an image forming apparatus according to an embodiment of the present invention will be explained hereinafter with reference to the accompanying drawings.

Figure 1:
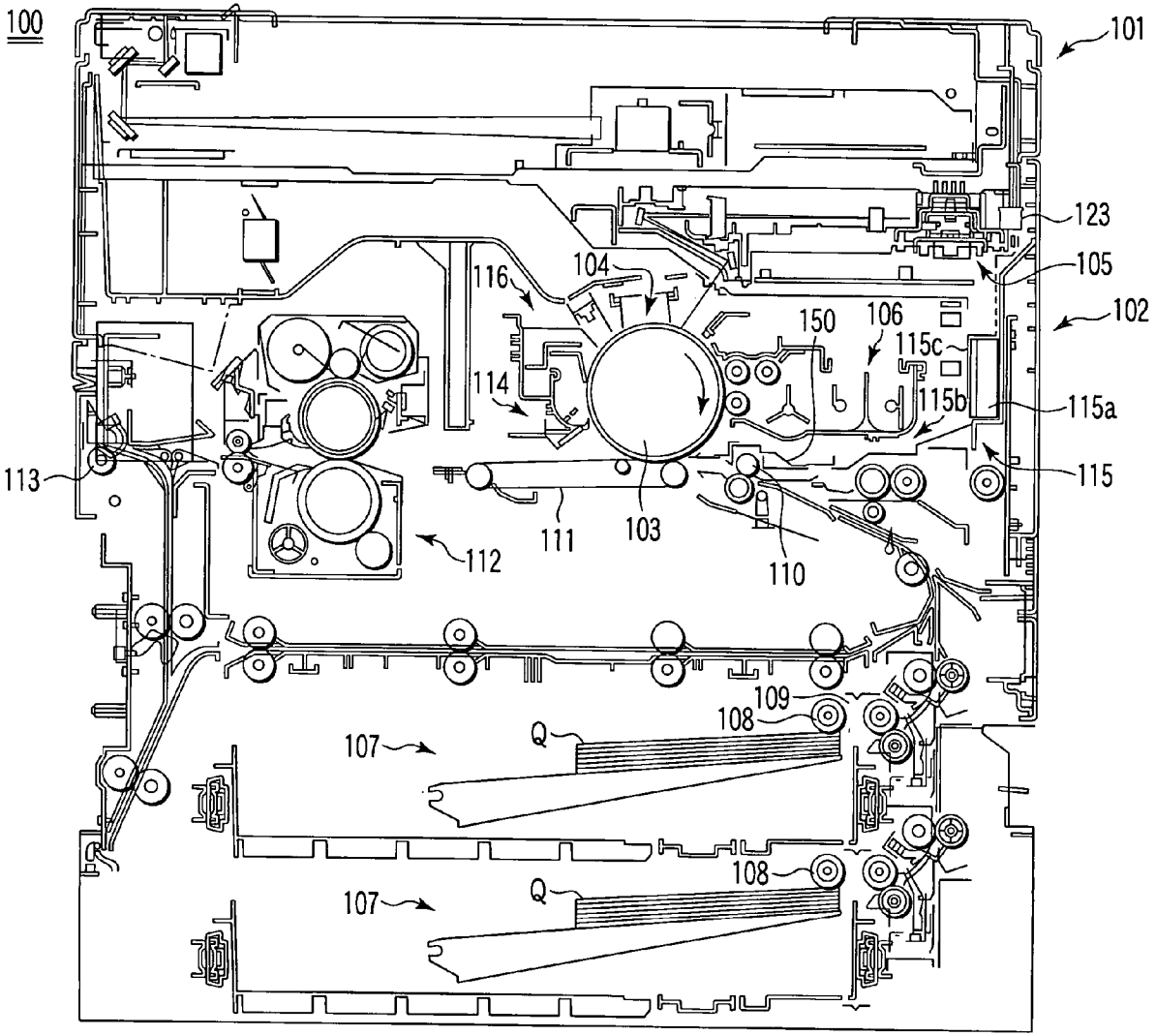
FIG. 1 is a schematic diagram explaining an image forming apparatus according to an embodiment of the present invention.

FIG. 1 schematically shows the front side of an image forming apparatus with a cover removed.

As shown in FIG. 1, an image forming apparatus (digital copier) 100 has an image reader (scanner) 101 which reads an image (original) to be read or copied and generates an image signal, and an image forming apparatus 102 which forms an image based on the image signal outputted from the scanner 101 or an image signal supplied from an external unit through an external interface 123.

The image forming apparatus 102 has a photoconductive drum 103, a charger 104, an exposing unit 105, a developing unit 106, a paper cassette 107, a pickup roller 108, a conveying roller 109, an aligning roller 110, a transfer unit 111, a fixing unit 112, a paper ejecting roller 113, a photoconductive drum cleaner 114, a duct mechanism 115, and a processing unit 116.

The photoconductive drum (image carrier, image carrying means) 103 has a photoconductive body on the circumference, which can hold for predetermined time an electrostatic image as a potential change in the area that light is irradiated in the state a predetermined potential is given. The photoconductive body may be formed like a belt as well as a drum.

The charger (charging means) 104 charges the surface of the photoconductive drum 103 to a predetermined potential. The charger 104 may be a corona wire, contact roller, or contact blade.

The exposing unit 105 is placed on the downstream side of the charger 104 in the rotating direction of the photoconductive drum 103, and exposes the photoconductive drum 103 to a laser beam LB whose intensity is changed corresponding to an image signal supplied from the scanner 101. When a predetermined image signal is externally supplied through an external interface 123, the exposing unit 105 can apply a laser beam LB corresponding to the image signal to the photoconductive drum 103. The laser beam LB can have a predetermined intensity corresponding to the density of image. The exposing unit 105 may use LED instead of a laser beam.

The developing unit (developing means) 106 is placed on the downstream side of the exposing unit 105 in the rotating direction of the photoconductive drum 103, contains 2-component developer consisting of carrier and toner, and supplies developer (toner) to the surface of the photoconductive drum 103. Thus, a latent image on the surface of the photoconductive drum 103 is visualized, and a toner image is formed. The developer may be 1-component developer consisting of toner only.

The paper cassette 107 contains paper Q. The pickup roller 108 picks up the paper Q one by one. The paper Q is conveyed to the aligning roller 110 by the conveying roller 109.

The aligning roller 110 rotates at a predetermined timing to match the position of the paper to the toner image formed on the photoconductive drum 103, and conveys the paper Q to a transfer position.

The transfer unit 111 gives the paper Q a predetermined potential, and transfers the toner image on the photoconductive drum 103 to the paper Q. The transfer unit 111 may be a corona wire, contact roller, or contact blade.

The fixing unit 112 gives predetermined heat and pressure to the paper Q holding the toner image, and fixes the fused toner image to the paper Q.

The paper ejecting roller 113 ejects the paper Q from the fixing unit 112 to a not-shown paper eject tray provided outside.

The photoconductive drum cleaner 114 is placed on the downstream side of the photoconductive drum 103 in the rotating direction of the photoconductive drum from the transfer position where the photoconductive drum 103 faces the transfer unit 111, and collects the toner adhered to the surface of the photoconductive drum 103. The photoconductive drum cleaner 114 includes a cleaning blade or a rotating brush, for example, which contacts the photoconductive drum 103.

The duct mechanism (suction mechanism) 115 includes a fan 115*a* to exhaust air from the apparatus to outside, and a duct 115*b* which is formed between the photoconductive drum 103 and fan 115*a*, and ensures the flow of air from the photoconductive drum 103 to the fan 115*a* by means of a case member 150 provided in the image forming apparatus 100. The duct mechanism 115 forms the flow of air from the downstream side of the developing unit 106 to outside in the rotating direction of the photoconductive drum 103.

The fan 115*a* is provided with a filter 115*c* in the duct 115*b*, and configured to collect scattered matter in the apparatus sucked by the fan 115*a*. Further, as described above, the air flow path is ensured by the case member 150 in the duct 115*b*, and the toner sucked through the duct 115*b* is prevented from dropping halfway onto the other members placed downward in the apparatus. Therefore, the paper Q conveyed from the paper cassette 107 is not stained with the scattered toner.

The processing unit 116 is composed of a photoconductive drum 103, a charger 104, a developing unit 106, and a photoconductive drum cleaner 114. The processing unit 116 is removable from the image forming apparatus.

Figure 2:
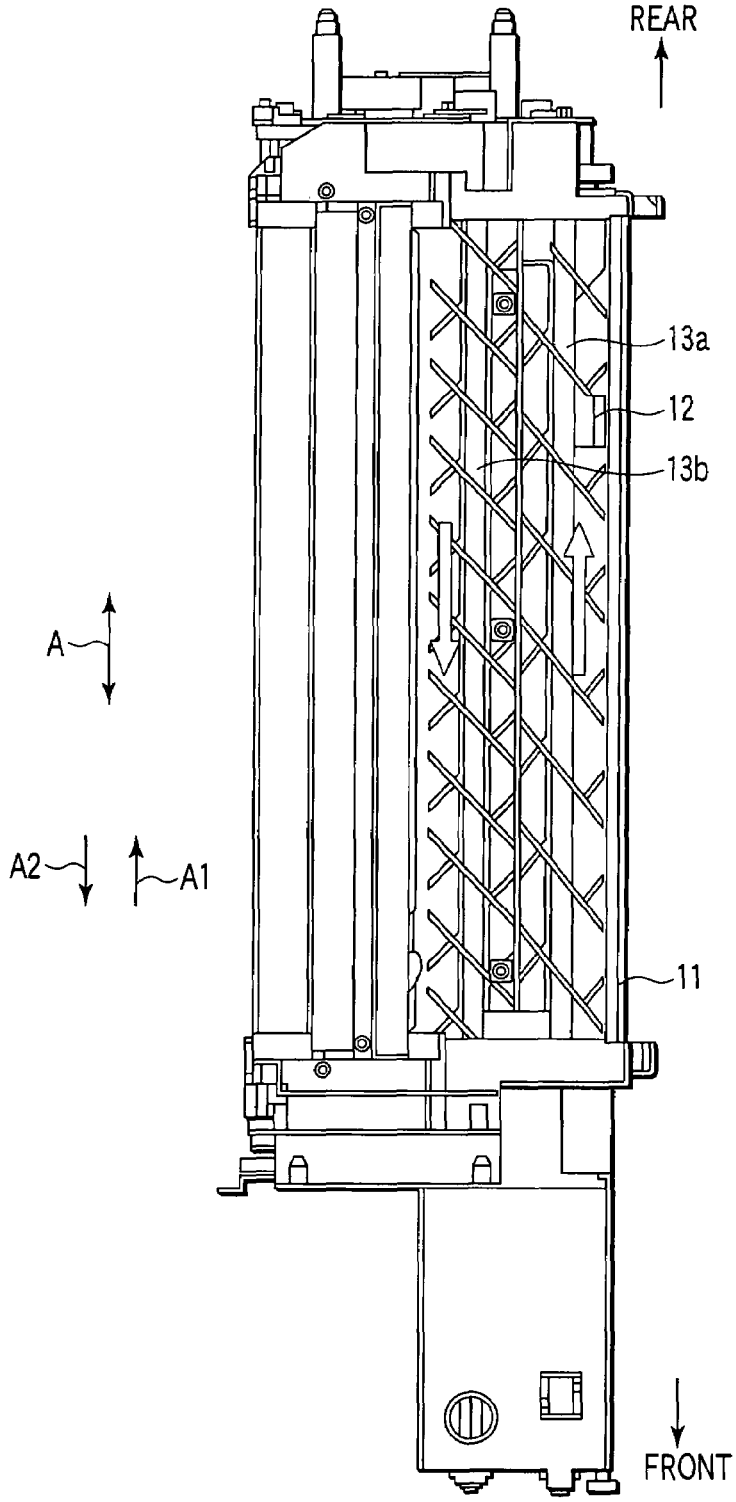
FIG. 2 is a schematic cross section viewed from the top of a developing unit incorporated into the image forming apparatus shown in FIG. 1.
Figure 3:
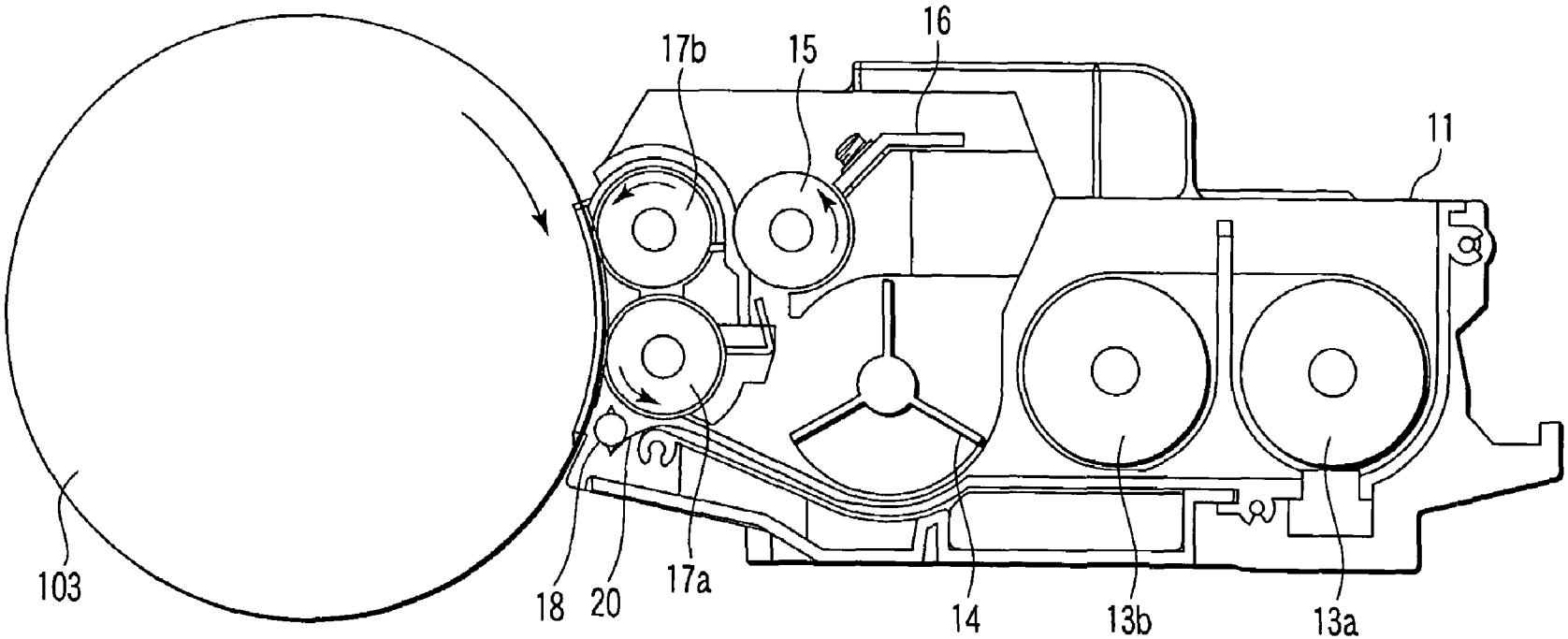
FIG. 3 is a schematic cross section of the developing unit shown in FIG. 2.
Figure 4:
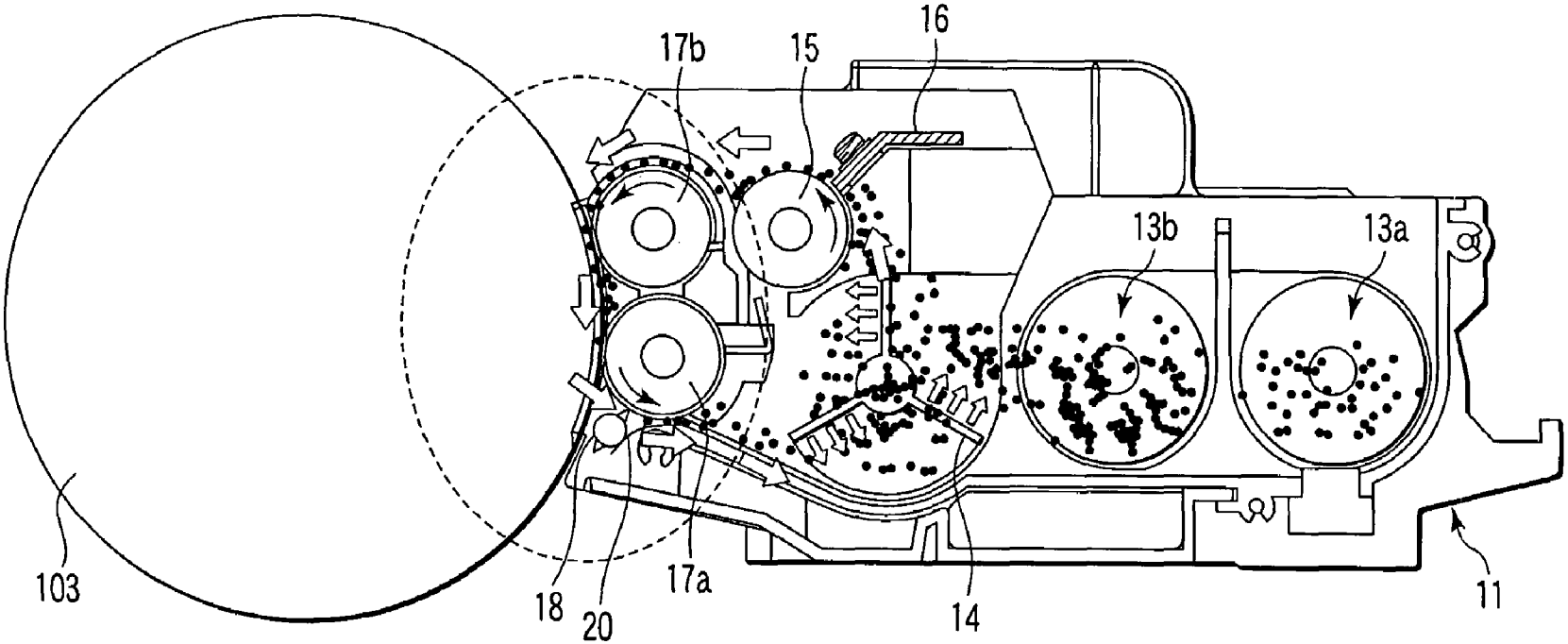
FIG. 4 is a schematic cross section of the developing unit shown in FIG. 2.
Figure 5:
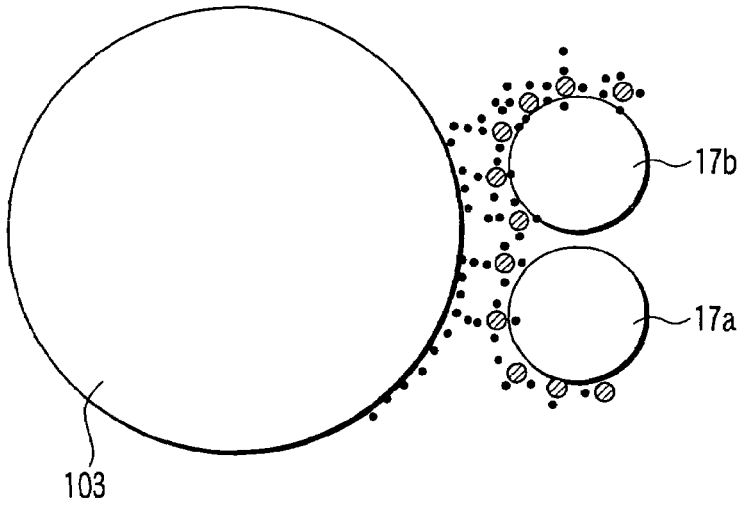
FIG. 5 is a magnified view of the part near the developing unit and photoconductive drum shown in FIG. 2.
Figure 6:
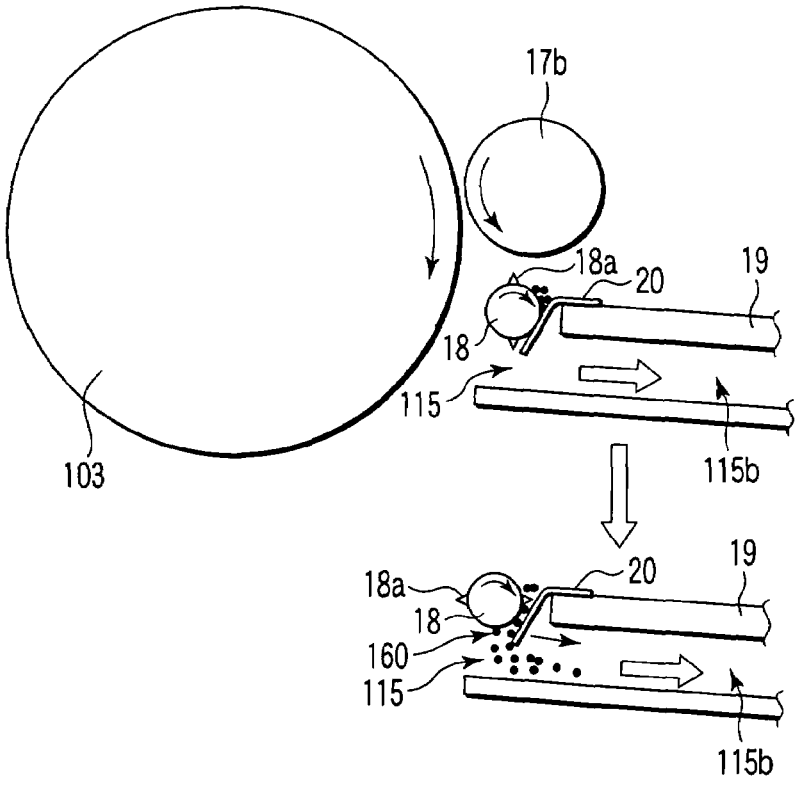
FIG. 6 is a magnified view of the part near the developing unit and photoconductive drum shown in FIG. 2.
Figure 7:
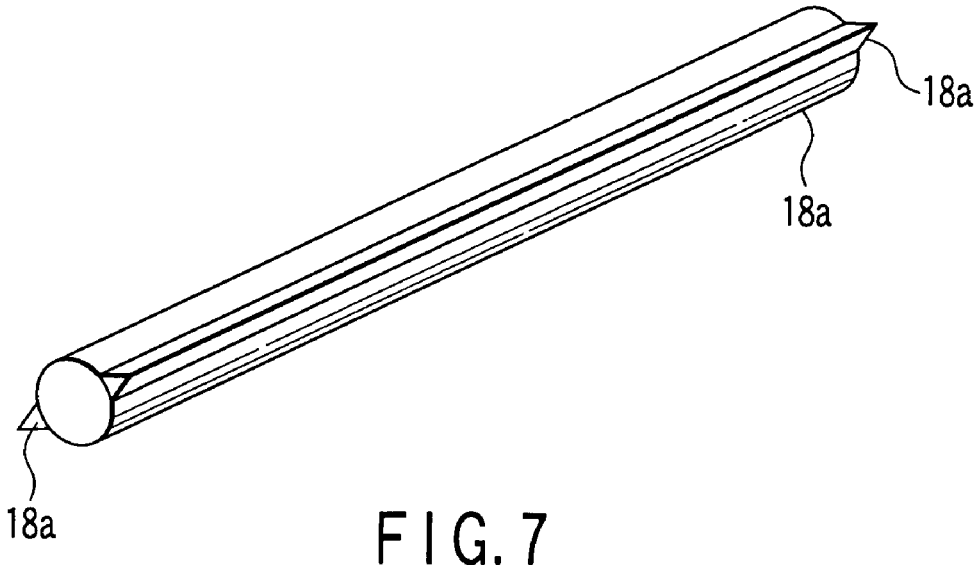
FIG. 7 is a schematic cross section of the collecting roller shown in FIG. 6.
Figure 8:
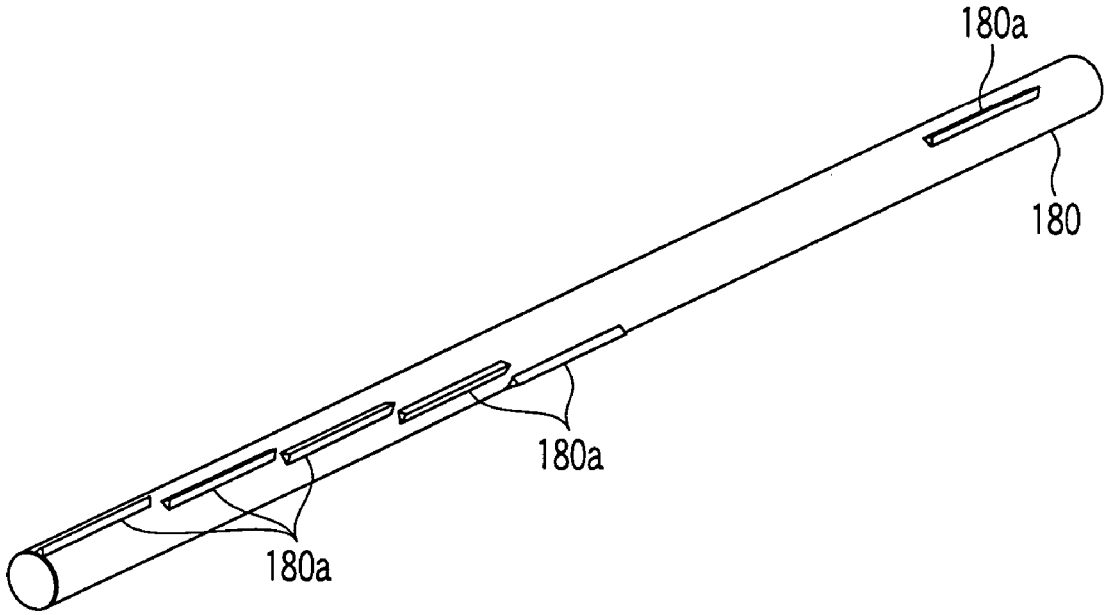
FIG. 8 is a schematic perspective view showing another example of the collecting roller shown in FIG. 7.

FIG. 2 is a schematic cross section viewed from the top of a developing unit 106. FIGS. 3 and 4 are schematic cross sections of the developing unit 106. FIGS. 5 and 6 show magnified views of the part in the vicinity of the developing unit 106 and photoconductive drum 103 shown in FIG. 3. FIGS. 7 and 8 show schematic perspective views of the collecting roller shown in FIG. 3.

As shown in FIGS. 2, 3 and 4, the developing unit 106 includes a developing unit casing 11 (developer container, developer containing means) to contain 2-component developer (hereinafter called a developer) consisting of carrier and toner, a magnetic sensor 12 to detect the toner density contained in the developing unit casing 11, and first mixer 13*a* and second mixer 13*b* having an axis parallel to the axial direction A of the photoconductive drum 103. The first mixer

13*a* is rotated to feed the developer in the first direction A1 from the front side of the image forming apparatus to the rear side, stirs the carrier and toner, and gives the toner a predetermined potential. The second mixer 13*b* is rotated to feed the developer in the second direction A2 from the rear side of the image forming apparatus to the front side, stirs the carrier and toner, and gives the toner a predetermined potential.

Between the second mixer 13*b* and photoconductive drum 103, there are provided a paddle 14, a conveying sleeve 15, a doctor blade 16, developing sleeves (developing member, developing means) 17*a* and 17*b*, a collecting roller (collecting member, collecting means) 18, and a resin sheet (elastic member) 20.

The paddle 14 is provided on the photoconductive drum 103 side of the second mixer 13*b*. The paddle 14 is rotated to supply the developer provided by the second mixer 13*b* to the conveying sleeve 15, stirs the carrier and toner, and gives the toner a predetermined potential by frictional charging.

The conveying sleeve 15 is configured to hold the developer supplied from the paddle 14 on the surface. The developer supplied to the surface of the conveying sleeve 15 is controlled the amount with the doctor blade 16 provided in the downstream side of the rotating direction from the point of supplying the developer by the paddle 14. Thus, appropriate amount of developer is supplied to the developing sleeves 17*a* and 17*b*.

The developing sleeves 17*a* and 17*b* are the sleeves, which include magnets with different polarities, and rotated in the direction opposite to the photoconductive drum 103 to hold the developer received from the conveying sleeve 15, that is, the toner and carrier. In this time, the carrier is held by the magnetism on the developing sleeves 17*a* and 17*b*, and the toner is electrostatically held by the carrier. Thus, the toner held by the developing sleeves 17*a* and 17*b* adjacent to the photoconductive drum 103 is adhered to the latent image on the photoconductive drum 103 based on the potential relationship with the photoconductive drum 103. Therefore, the electrostatic latent image formed on the photoconductive drum 103 is converted into a toner image. The present invention is not limited to the developing sleeves 17*a* and 17*b*. A magnet roller with many polarities may be used. An area where the developing sleeves 17*a* and 17*b* are opposite to the photoconductive drum 103 and toner is supplied from the developing sleeves 17*a* and 17*b* to the photoconductive drum 103, is called a developer supply position.

The collecting roller 18 is placed in the downstream side of the developing sleeve 17*b* in the rotating direction of the photoconductive drum 103, rotated in the direction opposite to the developing sleeve 17*b*, and collects the scattered toner occurred in a developing step of supplying toner from the developing sleeves 17*a* and 17*b* to the surface of the photoconductive drum 103.

The developing unit casing 11 has the form extended from the bottom to contain the developer near the paddle 14, to the part in the vicinity of the collecting roller 18. A gap is formed between the collecting roller 18 and developing unit casing 11.

The resin sheet 20 is placed in the gap between the collecting roller 18 and developing unit casing 11, and can remove the used toner adhered to the collecting roller 18.

In the downstream side of the collecting roller 18 in the rotating direction of the photoconductive drum 103, the duct mechanism 115 or the duct 115*b* is provided to ensure the flow of air from the photoconductive drum 103 to the fan 115*a*. The used toner not collected by the collecting roller 18 is sucked by the duct mechanism 115. Namely, the used toner is sucked by the fan 115*a* in the direction opposite to the photoconductive drum 103 by the flow of air formed in the duct 115*b*, and collected by the filter 115*c*.

Now the configuration in the vicinity of the collecting roller 18 will be explained in detail with reference to FIGS. 6 and 7. As shown in FIG. 7, the collecting roller 18 is a cylindrical bar-shaped member having the length equivalent to the length of the lengthwise direction of the photoconductive drum 103. A pair of scrapers (projection) 18*a* is formed at the positions of 180° different each other on the surface of the collecting roller 18. The scraper 18*a* is projected continuously over the total length of the lengthwise direction of the collecting roller 18, and tapered toward the outside of the collecting roller 18. In this embodiment, the scraper 18*a* is formed triangular in the cross section.

The resin sheet 20 has the length equivalent to the lengthwise direction of the collecting roller 18. One end of the longish side is fixed to the end portion of the developing unit casing 11, and the other end contacts the collecting roller 18. The resin sheet 20 has the hardness to be bent by the rotation of the collecting roller 18, and contacts the surface of the collecting roller 18. In this embodiment, the resin sheet 20 is made of urethane resin as soft resin material.

Namely, the resin sheet 20 has the shorter size that is longer than the gap formed between the collecting roller 18 and developing unit casing 11, and is fixed to project toward the collecting roller 18 in the state fixed to the developing unit casing 11, and curved downward along the rotating direction of the collecting roller 18 that rotates clockwise. Thus, the resin sheet 20 is pressed to the surface of the collecting roller 18 by the returning force. Therefore, the resin sheet 20 can scrape the used toner collected by the collecting roller 18, by contacting the surface of the collecting roller 18.

When the collecting roller 18 rotates, the resin sheet 20 is bent further in the curving direction by the scraper 18*a*, and the used toner scraped by the scraper 18*a* is ejected to the duct mechanism 115. Thus, the scattered used toner (hereinafter called scattered toner) is sucked by the fan 115*a* through the duct 115*b*, and collected by the filter 115*c*. The eject position 160 of the toner scraped by the scraper 18*a* by bending the resin sheet 20 is provided on the opposite side of the photoconductive drum 103 in the collecting roller 18. As the eject position 160 is provided at the position far from the photoconductive drum 103, the scattered toner is difficult to adhere to the photoconductive drum 103. This prevents formation of a defective image.

When the collecting roller 18 rotates, the scraper 18*a* bends the resin sheet 18*a* further in the curving direction, and gives vibration to the resin sheet 18*a*. Thus, the used toner stayed between the collecting roller 18 and resin sheet 20 is scraped and scattered toward the duct mechanism 115. The scattered toner is sucked by the fan 115*a* through the duct 115*b* and collected by the filter 115*c*.

Therefore, adhesion of the toner to the photoconductive drum 103 can be prevented when the scattered toner is collected, and a good image can be formed. Long time staying of used toner between the collecting roller 18 and resin sheet 20 can be prevented, and scattering of stayed used toner to the photoconductive drum 103 can also be prevented.

As described above, the resin sheet 20 is mode of soft material such as urethane resin. This minimizes damage given to the surface of the collecting roller 18 when contacted with the resin sheet 20, and increases the life expectancy of the collecting roller 18. If a sheet made of flexible (hard) material such as polyester film is used in this embodiment, the returning force of the sheet bent by the collecting roller 18 is too strong, and the used toner stacked between the collecting roller 18 and resin sheet 20 is splashed and scattered to the photoconductive drum 103. Thus, the used toner adheres to the surface of the photoconductive drum 103, and a defective image may be formed. Since soft material such as urethane resin is used for the resin sheet 20 as in this embodiment, the vibration given by the restoration of the resin sheet 20 to the collecting roller 18, scraper 18*a* or resin sheet 20 is not too large, and the used toner to be scattered by the impact does not reach the photoconductive roller 103.

Further, as in this embodiment, when used toner is collected by bringing the resin sheet 20 into contact with the collecting roller 18, the used toner stacks on the resin sheet 20 and easily becomes a lump of toner. If such a lump of toner adheres to the photoconductive drum 103, a defective image is formed. Further, even if a lump of used toner returns to the developing unit casing 11, the toner lamp cannot be used for a developing step. By controlling impact by using the resin sheet 20 made of soft material as described above, scattering of such a lump of toner to the photoconductive drum 103 is prevented, and the toner can be collected by sucking through the duct 115 by using the filter 115*c*.

Further, as described above, by placing the resin sheet 20 in the gap between the collecting roller 18 and developing unit casing 11, suction of the toner adhered to the developing sleeve 17*b* by the sucking force of the duct mechanism 115 can be prevented. Thus, toner can be efficiently supplied to the photoconductive drum 103, and absorption of unused toner by the duct mechanism 115 can also be prevented. Therefore, toner can be economically used.

Further, as described above, the scraper 18*a* formed on the collecting roller 18 are tapered, and the area contacting the resin sheet 20 can be minimized. This decreases damage to the resin sheet 20, and increases the life expectancy of the resin sheet 20. Further, as in this embodiment, by using the scraper 18*a* formed continuously in the lengthwise direction of the collecting roller 18, the resin sheet 20 can be bent by an even force. As a stress applied to the resin sheet 20 becomes even, scattering of toner to the photoconductive drum 103 can be prevented.

Moreover, the resin sheet 20 is bent downward the collecting roller 18 (to the duct mechanism 115), the scraper 18*a* is rotated to scrape toner to the opposite side of the photoconductive drum 103, and the eject position 160 to eject scattered toner to the duct mechanism 115 is provided on the opposite side of the photoconductive drum 103. This prevents scattering of toner to the photoconductive drum 103. A flow of air from the inside of the developing unit 106 to the photoconductive drum 103 is formed by the rotation of the paddle 14 between the developing sleeve 17*b* and collecting roller 18. Thus, if toner stacks in the developing sleeve 17*b* side of the collecting roller 18, the stacked toner may be scattered to the photoconductive drum 103 by the air from the inside of the developing unit 106. By bending the resin sheet 20 downward the collecting roller 18 as in this embodiment, toner is difficult to stack in the developing sleeve 17*b* side of the collecting roller 18, and scattered toner does not adhere to the photoconductive drum 103.

The present invention is not limited to the above-described embodiments. The invention may be embodied in other specific forms without departing from its spirit or essential characteristics. The invention may be formed by appropriately combining the components disclosed in the above-described embodiments. For example, some components may be deleted from the embodiments. The components of different embodiments may be combined.

For example, in the described embodiments, the duct 115 is provided under the eject position 160 to eject the toner scraped when the resin sheet 20 is pressed and bent by the rotation of the collecting roller 18. However, the invention is not limited to this configuration. A container (containing means) may be provided under the eject position 160 to receive the toner ejected from the eject position 160.

The scraper 18*a* formed on the collecting roller 18 is continuously projected in the lengthwise direction of the collecting roller 18. However, the present invention is not limited to this configuration. For example, as shown in FIG. 8, a scraper 180*a* may be formed discontinuously and partially in the lengthwise direction of the collecting roller 180.

As shown in FIG. 8, the collecting roller 180 has slender projection-shaped scrapers 180*a* in the axial direction. These scrapers 180*a* are arranged displaced in the circumferential direction of the collecting roller 180. All the scrapers 180*a* are formed over the total length of the collecting roller 180. Namely, the scrapers 180*a* of the collecting roller 180 are arranged without a gap in the axial direction, so that the resin sheet 20 does not have an area not contacting the scrapers 180*a* of the rotating collecting roller 180.

By the above configuration, the scrapers can contact the whole surface of the resin sheet 20, and can collect the toner adhered to the resin sheet 20 without remaining the toner, and can eject the toner to the duct mechanism 115. Further, by displacing the position of the scraper 180*a* in the circumferential direction, the force of the resin sheet 20 pressed by the scraper 180*a* to return upward can be decreased, and the vibration given by the restoration of the resin sheet 20 to the collecting roller 180, scraper 180*a* or resin sheet 20 is not much increased. Thus, scattering of used toner caused by the impact to the photoconductive roller 103 can be prevented.

In addition, the scraper 18*a* is tapered, but the present invention is not limited to this structure. For example, the tip may be curved or formed like a sheet.

What is claimed is:

1. A developing unit comprising:

a developer container to contain developer;

a developing member to supply the developer to an image carrier;

a collecting member which is placed in the vicinity of a developer supply position to supply the developer from the developing member to the image carrier, and collects the developer scattered when supplied from the developing member to the image carrier;

an elastic member which is provided in a gap between the developer container and the collecting member, and pressed to the collecting member with one end fixed to the developer container by being pressed and bent along the rotating direction of the collecting member; and a projection which has a form projected from the surface of the collecting member, and scrapes the developer adhered to the elastic member by pressing and bending the elastic member by the rotation of the collecting member.

2. The developing unit according to claim 1, wherein an eject position to eject the developer passing between the collecting member and the elastic member pressed and bent by the projection upon rotation of the collecting member is opposite to the image carrier in the collecting member.

3. The developing unit according to claim 2, wherein a suction mechanism to suck the developer ejected from the eject position to the opposite side of the image carrier is provided under the eject position.

4. The developing unit according to claim 2, wherein a container to contain the developer ejected from the eject position is provided under the eject position.

5. The developing unit according to claim 1, wherein the projection is projected continuously in the axial direction over the total length of the collecting member.

6. The developing unit according to claim 1, wherein the projection is formed as a long projection in the axial direction of the collecting member, and provided partially in more than one on the surface of the collecting member.

7. An image forming apparatus comprising:

an image carrier to carry electrostatically a developer image formed with a developer;

a developer container to contain developer;

a developing member to supply the developer to the image carrier;

a collecting member which is placed in the vicinity of a developer supply position to supply the developer from the developing member to the image carrier, and collects the developer scattered when supplied from the developing member to the image carrier;

an elastic member which is provided in a gap between the developer container and the collecting member, and pressed to the collecting member with one end fixed to the developer container by being pressed and bent along the rotating direction of the collecting member; and a projection which has a form projected from the surface of the collecting member, and scrapes the developer adhered to the elastic member by pressing and bending the elastic member by the rotation of the collecting member.

8. The image forming apparatus according to claim 7, further comprising a charger to charge the surface of the image carrier to a predetermined potential; and a processing unit which includes the image carrier and at least one of the developing member and charger, and is removable from the image forming apparatus.

9. The image forming apparatus according to claim 7, wherein an eject position to eject the developer passing between the collecting member and the elastic member pressed and bent by the projection upon rotation of the collecting member is opposite to the image carrier in the collecting member.

10. The image forming apparatus according to claim 9, wherein a suction path to suck the developer ejected from the eject position to the opposite side of the image carrier is provided under the eject position.

11. The image forming apparatus according to claim 9, wherein a container to contain the developer ejected from the eject position is provided under the eject position.

12. The image forming apparatus according to claim 7, wherein the projection is projected continuously in the axial direction over the total length of the collecting member.

13. The image forming apparatus according to claim 7, wherein the projection is formed as a long projection in the axial direction of the collecting member, and provided partially in more than one on the surface of the collecting member.

14. An image forming apparatus comprising:

an image carrying means for carrying electrostatically a developer image formed with a developer;

a developer containing means for containing developer;

a developer supplying means for supplying the developer to the image carrying means;

a collecting means which is a member provided rotatably, placed in the vicinity of a developer supply position to supply the developer from the developer supplying means to the image carrying means, and collects the developer scattered when supplied from the developer supplying means to the image carrying means;

an elastic member which is provided in a gap between the developer containing means and the collecting member, and pressed to the collecting means with one end fixed to the developer containing means by being pressed and bent along the rotating direction of the collecting means; and a projection which has a form projected from the surface of the collecting means, and scrapes the developer adhered to the elastic member by pressing and bending the elastic member by the rotation of the collecting member.

15. The image forming apparatus according to claim 14, further comprising a charging means to charge the surface of the image carrying means to a predetermined potential; and a processing unit which includes the image carrying means and at least one of the developing means and charging means, and is removable from the image forming apparatus.

16. The image forming apparatus according to claim 14, wherein an eject position to eject the developer passing between the collecting means and the elastic member pressed and bent by the projection upon rotation of the collecting means is opposite to the image carrying means in the collecting means.

17. The image forming apparatus according to claim 16, wherein a suction path to suck the developer ejected from the eject position to the opposite side of the image carrying means is provided under the eject position.

18. The image forming apparatus according to claim 14, wherein the projection is projected continuously in the axial direction over the total length of the collecting means.

19. The image forming apparatus according to claim 14, wherein the projection is formed as a long projection in the axial direction of the collecting means, and provided partially in more than one on the surface of the collecting means.

20. A developer collecting method comprising:

supplying developer to the surface of an image carrier;

collecting the developer scattered when being supplied, with a collecting member having a projection projected from the surface;

scraping the developer collected by the collecting member, by an elastic member pressed to the collecting member; and ejecting the developer scrapped by the elastic member, by the projection of the collecting member pressed to the elastic member.

* * * * *